US005279750A

United States Patent [19]

Hanano

[11] Patent Number: 5,279,750

[45] **Date of Patent: * Jan. 18, 1994**

[54] METHOD FOR SQUEEZE CASTING POWDERY MOLD RELEASING AGENT

[75] Inventor: Takashi Hanano, Kobe, Japan

[73] Assignee: Hanano Commercial Co., Ltd., Hyogo, Japan

[ * ] Notice: The portion of the term of this patent subsequent to Jan. 11, 2011 has been disclaimed.

[21] Appl. No.: 915,763

[22] Filed: Jul. 21, 1992

Related U.S. Application Data

[62] Division of Ser. No. 693,909, 5/1/91 Abandoned

[30] Foreign Application Priority Data

Mar. 6, 1991 [JP] Japan ..... 3-067975

[51] Int. Cl.[5] ..... C10M 103/00; B28B 7/36

[52] U.S. Cl. ..... 252/21; 252/25; 252/29; 252/18; 106/38.22

[58] Field of Search ..... 252/12, 12.6, 18, 21, 252/25, 29; 106/38.22, 38.24

[56] References Cited

U.S. PATENT DOCUMENTS

| | | | |
|---|---|---|---|
| 3,779,918 | 12/1973 | Ikeda et al. | 252/12.6 |
| 3,856,686 | 12/1974 | Sato et al. | 252/29 |
| 3,874,862 | 4/1975 | Bickling, Jr. et al. | 252/29 |
| 3,909,424 | 9/1975 | Clark | 252/12 |
| 3,985,661 | 10/1976 | Ikeda et al. | 252/12 |
| 4,071,368 | 1/1978 | Jones | 252/30 |
| 4,148,970 | 4/1979 | McIntosh et al. | 252/25 |
| 4,202,523 | 5/1980 | Radtke | 252/25 |
| 4,310,427 | 1/1982 | Wun | 252/21 |
| 4,575,430 | 3/1986 | Periard et al. | 252/12 |
| 5,039,435 | 8/1991 | Hanano | 252/18 |

OTHER PUBLICATIONS

Metals Handbook, Ninth Edition, vol. 15, *Casting* ASM International 1989, pp. 323-326.

Hawley's Condensed Chemical Dictionary, 11th Ed., Van Nostrand Reihhold, N.Y., pp. 576, 794.

*Primary Examiner*—Prince Willis, Jr.
*Assistant Examiner*—J. Silbermann
*Attorney, Agent, or Firm*—Armstrong, Westerman, Hattori, McLeland & Naughton

[57] ABSTRACT

A squeeze casting powdery mold releasing agent according to this invention consists of a granulated or powdery mixture of a lubricant, an organic polymer and a metal soap; wherein the lubricant is coated with the organic polymer or the metal soap. Therefore, the mold releasing agent allows productions of castings of high quality, in a squeeze casting work, with good workability and without worsening environmental situations.

5 Claims, No Drawings

METHOD FOR SQUEEZE CASTING POWDERY MOLD RELEASING AGENT

This application is a division of application Ser. No. 693,909, filed May 1, 1991, now abandoned.

BACKGROUND OF THE INVENTION

1. Industrial Useful Field

This invention relates to a mold releasing agent which is used by being sprayed onto inside surfaces of a molding die in a squeeze casting work which includes a forging cast work.

2. Prior Art

A squeeze casting method which includes a forging cast is being utilized widely in manufacturing various parts for automobile and electrical equipment because cast parts of high precision can be manufactured continuously and in large quantities by this method. And, in this squeeze casting method, a mold releasing agent is used in order to prevent a molding die from direct contact with molten metal for avoiding seizure and for improving release of products from dies.

The squeeze casting mold releasing agent is generally classified into two principal groups: a water soluble mold releasing agent and a water insoluble mold releasing agent. Among these agents, the water insoluble mold releasing agent includes problems from standpoint of safety because of its large danger due to smoke and flammability so that the water soluble mold releasing agent is being used frequently. The water soluble mold releasing agent is generally composed of mold releasing base materials such as water, mineral oil etc., to which silicon oil, synthetic or natural wax, fats and oils, fatty acid ester etc. for use as surface active agent or extreme pressure providing agent, are annexed. (Problems to be solved by the Invention)

Incidentally, with a progress of squeeze casting technology in recent years, there has been an increasing demand for a mold releasing agent to obtain products of high quality with better workability. However, it has become impossible to satisfy this demand by using the water soluble mold releasing agent. Namely, the water soluble mold releasing agent has included problems that control of die temperature has been difficult due to its water solubility and there has been a high possibility of defects arising in product insides due to remaining water. Further, there has been a problem that liquid-waste treatment has become required for prevention of water pollution to induce increases in various expenses for plant and equipment investment. Therefore, a strong demand for a mold releasing agent of a new type has arisen.

SUMMARY OF THE INVENTION

This invention has been made on the basis of detailed studies and systematic experiments in due consideration of the foregoing situations. An object of this invention is to provide a squeeze casting mold releasing agent for obtaining cast products of higher quality with better workability and without worsening environmental conditions; namely, in more concrete form, to provide a mold releasing agent which can securely prevent seizure of products and occurrence of inside defects to improve die-releasing ability of products from dies, can be easily removed from die insides and product surfaces after use, and permits no generation of gas during casting and no pollution of water after casting.

This invention is, in a squeeze casting mold releasing agent which is used by being sprayed onto inside surfaces of a molding die in a squeeze casting work which includes a forging cast work; a squeeze casting powdery mold releasing agent consisting essentially of a granulated or powdery mixture of a lubricant selected from the group consisting of boron nitride, silicon nitride, molybdenum disulfide, graphite, mica, metal oxides, sulfur compound, fluoride, talc, boron compound and phosphorus compound; an organic polymer selected from the group consisting of polyethylene, polypropylene, polystyrene, epoxy resin, silicon resin, phenol resin, acrylate resin and alkyd resin; and a metal soap; wherein the lubricant is coated with the organic polymer or the metal soap.

DETAILED DESCRIPTION OF THE INVENTION

The most outstanding feature of this invention is to consist of a granulated or powdery mixture of a lubricant, an organic polymer and a metal soap, and that the lubricant is coated with the organic polymer or the metal soap.

It is effective to select a content of the organic polymer and the metal soap in relation to the lubricant from a range of 0.1 through 45 weight percent. The reason is that the adhesion effect of the lubricant to metal mold insides is not enough when the content is smaller than 0.1 weight percent, and a build-up occurs to cause a difficulty in removing the mold releasing agent from the metal mold insides, i.e. a decrease in mold releasing efficiency or a worsening of dimensional accuracy of product when the content is larger than 45 weight percent.

There is no limitation to the lubricant for use in the present invention, provided that they are composed of solid inorganic compound used for lubricant.

Generally, boron nitride, mica, metal oxides, silicon nitride, sulfur compound, fluoride, talc, boron compound and phosphorus compound are preferably used therefor. However, other well known solid lubricants may be used therefor, which have conventionally been used as the mold releasing agent, such as molybdenum disulfide, graphite etc. These lubricants have powdery or granulated form, and only one kind of them or two or more kinds thereof are used in combined form.

Further, there is no special limitation to the organic polymer and the metal soap used for the present invention, provided that they have characteristics of giving the adhesive and bonding properties to the foregoing lubricants. Sodium, calcium, barium, lithium, potassium, magnesium or zinc salts of carboxylic acid is used for the metal soap; and polyethylene, polypropylene, epoxy resin, silicon resin, phenol resin, acrylate resin, alkyd resin or polystyrene are preferably used for the organic polymer. These organic polymers and metal soaps are mixed with the lubricant in a heated molten state. Accordingly, in the mold releasing agent according to the present invention, the lubricant is coated with the organic polymer or the metal soap. Incidentally, only one kind of the above-mentioned organic polymers and the metal soaps is used, or two or more kinds of them are used in combined form.

Function

In the squeeze casting powdery mold releasing agent according to the present invention, the lubricant has the powdery or granulated form so that the product is surely separated from the metal mold inside surface at least by a particle diameter of powder or granule of the lubricant at a part of the metal mold inside surface to which the mold releasing agent adheres. Consequently, the mold releasing agent adheres uniformly to the whole metal mold inside surface so that the seizure caused by the direct contact of the product with the metal mold inside surface can be avoided without fail. Further, since the mold releasing agent according to this invention is composed of the lubricant, the organic polymer and the metal soap and does not include water content, no defect due to remaining water arises in the product inside surface. Accordingly, the quality of product can be improved.

Moreover, in the mold releasing agent according to the present invention, the lubricant has the powdery or granulated form and does not include water content so that a tension working between the metal mold inside surface and the product is weak. Therefore, taking-out of the product from the metal mold becomes easy. Furthermore, the mold releasing agent can be removed easily from the metal mold inside surface and the product surface.

In addition, in the mold releasing agent of this invention, the lubricant has the powdery or granulated form so that the material is hard to react and scarcely generates gas even if it is subjected to heat during squeeze casting. And, this agent does not produce water pollution after casting as encounterd in the case of water soluble mold releasing agent. Therefore, worsening of field environment can be avoided and expenses for liquid-waste treatment become unnecessary to cut off maintenance cost.

Effect of the Invention

In this invention, the squeeze casting mold releasing agent does not include water content and the lubricant has the powdery or granulated form. Therefore, castings produced by means of the squeeze casting method, such as aluminium alloy and zinc alloy etc., can be surely prevented from seizures and inside defects; to be improved the quality of casting; the casting work based on the squeeze casting can be carried out with good workability; and the worsening of environment before and after use of agent can be fully avoided. Especially, the quality of obtained castings can be improved by settling the content of the organic polymer and the metal soap in relation to the lubricant to the range of 0.1 through 45 weight percent.

Further, the above-mentioned effect can be enhanced still more when sodium, calcium, barium, lithium, potassium, magnessium or zinc salts of carboxylic acid is used for the metal soap, and polyethylene, polypropylene, epoxy resin, silicon resin, phenol resin, acrylate resin, alkyd resin or polystyrene is used for the organic polymer.

EMBODIMENTS

Embodiments of the present invention will be described below, but the invention is not limitted to these embodiments.

Following mold releasing agents (A) through (F) were obtained, casting tests based on the squeeze casting method were carried out by using these mold releasing agents, and items listed in the TABLE were compared and examined.

Two kinds of mixtures: a mixture wherein the organic polymer or the metal soap is mixed with the lubricant in powdery or granulated form, and a mixture wherein the organic polymer or the metal soap is mixed with the lubricant in a heated molten state; were obtained for the embodiments (A) through (C) of the present invention.

The two kinds of mixtures were examined and obtained results were the same for the both mixtures. Incidentally, compounds as used for the mold releasing agents (A) through (F) are those available in the market.

(A) First embodiment comprising a mixture of 95 parts of boron nitride (average particle size: 1 through 5 microns) and 5 parts of calcium stearate (B) Second embodiment comprising a mixture of 20 parts of boron nitride, 75 parts of mica and 5 parts of polyethylene (C) Third embodiment comprising a mixture of 50 parts of boron nitride, 45 parts of silicon nitride, 3 parts of barium stearate and 2 parts of polypropylene (D) Boron nitride only (comparison embodiment 1)

(E) Water soluble mold releasing agent containing, as major components, wax and silicon oil at a ratio of 1:80 (comparison embodiment 2)

(F) Water soluble mold releasing agent on the market comprising of wax, silicon oil and graphite (comparison embodiment 3),

TABLE

| | (A) | (B) | (C) | (D) | (E) | (F) |
|---|---|---|---|---|---|---|
| Adhesion to metal mold | ∘ | @ | @ | x | ∘ | ∘ |
| Effect for preventing seizure | @ | @ | @ | — | ∘ | ∘ |
| Effect for preventing defects in product inside | @ | @ | @ | — | * | * |
| Effect for preventing worsening of field environment due to generation of smoke and steam | @ | @ | @ | — | * | x |

x: Compretely non, —: Measurement impossible, *: Small, ∘: Intermediate, @: Large

What is claimed is:

1. In a method for squeeze casting, comprising applying a mold releasing agent onto inside surfaces of a molding die in a squeezing casting work which includes a forging cast work, the improvement comprising applying a squeeze casting powdery mold releasing agent consisting of a granulated or powdery mixture of:

(a) a lubricant selected from the group consisting of silicon nitride, molybdenum disulfide, graphite, mica, metal oxides, sulfur compound, fluoride, talc, boron compound and phosphorous compound;

(b) an organic polymer selected from the group consisting of polyethylene, polypropylene, polystyrene, epoxy resin, silicon resin, phenol resin, acrylate resin and alkyd resin; and (c) a metal soap selected from the group consisting of sodium, calcium, barium, lithium, potassium, magnesium and zinc salts of carboxylic acid;

wherein the lubricant is coated with the organic polymer or the metal soap.

2. The method according to claim 1, wherein the squeezing casting powdery mold releasing agent contains 0.1 to 45 wt % of the organic polymer and the metal soap in relation to the lubricant.

3. The method according to claim 1, wherein the mold releasing agent is sprayed onto inside surfaces of the molding die.

4. The method according to claim 1, wherein the lubricant is boron nitride.

5. In a method for squeeze casting, comprising applying a mold releasing agent onto inside surfaces of a molding die in a squeezing casting work which includes a forging cast work, the improvement comprising applying a squeeze casting powdery mold releasing agent to the molding die, the mold releasing agent consisting of a granulated or powdery mixture of:

(a) a lubricant selected from the group consisting of boron nitride, silicon nitride, molybdenum disulfide, graphite, mica, metal oxides, fluoride and talc;

(b) an organic polymer selected from the group consisting of polyethylene, polypropylene, polystyrene and epoxy resin; and (c) a metal soap selected from the group consisting of sodium, calcium, barium, lithium, potassium, magnesium and zinc salts of carboxylic acid;

wherein the lubricant is coated with the organic polymer or the metal soap.

* * * * *